United States Patent [19]

Weigl et al.

[11] 4,022,493

[45] May 10, 1977

[54] ADJUSTING MECHANISM FOR SKI BINDINGS

[75] Inventors: Erwin Weigl, Brunn am Gebirge; Josef Svoboda, Schwechat, both of Austria

[73] Assignee: Gertsch AG, Zug, Switzerland

[22] Filed: Aug. 15, 1975

[21] Appl. No.: 604,913

[30] Foreign Application Priority Data

Sept. 13, 1974 Austria ..... 7442/74

[52] U.S. Cl. ..... 280/633

[51] Int. Cl.[2] ..... A63C 9/22

[58] Field of Search ..... 280/11.35 T, 11.35 E, 280/11.35 H, 11.35 R, 11.35 D, 633, 634; 9/310 AA

[56] References Cited

UNITED STATES PATENTS

| | | | |
|---|---|---|---|
| 3,125,349 | 3/1964 | Schweizer | 280/11.35 T |
| 3,137,014 | 6/1964 | Meucci | 9/310 AA |
| 3,785,666 | 1/1974 | Salomon | 280/11.35 T |
| 3,807,748 | 4/1974 | Ramillon | 280/11.35 T |
| 3,836,163 | 9/1974 | Hashioka | 280/11.35 T |

FOREIGN PATENTS OR APPLICATIONS

| | | | |
|---|---|---|---|
| 1,528,053 | 4/1968 | France | 280/11.35 R |
| 480,848 | 12/1969 | Switzerland | 280/11.35 R |
| 469,492 | 4/1969 | Switzerland | 280/11.35 T |

*Primary Examiner*—Joseph F. Peters, Jr.
*Assistant Examiner*—David M. Mitchell
*Attorney, Agent, or Firm*—Woodhams, Blanchard and Flynn

[57] ABSTRACT

A device for mounting a binding component onto a ski and providing for longitudinal adjustment thereof on and with respect to the ski. A carriage for carrying the binding component is arranged for slidable adjustment along a ski. Either the carriage or a device fixed to the ski carry a toothed rail and the other thereof carries a toothed locator positioned for crosswise motion relative to the ski into and out of engagement with the toothed rail. A light spring holds the locator in normal engagement with the toothed rail. A manual device is provided for disengagement of the parts upon moving of the locator crosswise of the ski against the spring. This enables the spring to be relatively light inasmuch as it functions only to hold the locator in rail engaging position and the locator may be easily disengaged by simply direct movement thereof against the spring. After adjustment of the carriage is completed, the locator may be caused to reengage with the toothed rail by releasing same to permit the spring to move the locator back to a position effecting such engagement.

5 Claims, 3 Drawing Figures

ADJUSTING MECHANISM FOR SKI BINDINGS

FIELD OF THE INVENTION

The invention relates to an adjusting mechanism for ski bindings, and particularly to one comprising a carriage which carries the binding part and a base plate which is secured on the ski and forms a guideway for the carriage, wherein a toothed rail is provided which is engaged by a toothed locator and arranged on a slide member which is movable transversely to the longitudinal direction of the ski against the force of a spring.

BACKGROUND OF THE INVENTION

Ski binding means are known which are arranged on a movable carriage and held releasably in position by engagement of a spring-loaded toothed locator with a toothed rail. A torsion spring is herein used as a spring, same being wound around a set screw and cooperating with its free end with the toothed locator. To release the engagement, the toothed locator is pulled outwardly against the force of the spring. However, adjusting thereof is also possible by loading the binding in the direction toward the ski boot. The tooth construction is of a saw-tooth shape so that the teeth block only one movement of the binding, or of the carriage, in the one direction. In the other direction, the toothed locator is pressed automatically outwardly by the slope of the teeth. There is in this arrangement some danger of an unintended change in positioning which considerably diminishes its safety.

In a further known device, the carriage which is connected with the binding has a pin, on which is arranged a plate, which has tooth segments on opposite sides thereof. These tooth segments engage teeth which are formed on rails which are fixed to the ski. A crossbar having laterally projecting handles is secured on the plate. A leaf spring acts onto the crossbar and thus onto the plate carrying the tooth segments for holding the tooth segments in engagement with the teeth. By pulling up on the handles of the crossbar against the force of the leaf spring, the engagement can be released and the carriage with the binding can be moved. In such a construction, practically twice the number, namely two toothed rails and two toothed locators, are needed. The handles must be gripped by gripping around the binding and this is difficult, especially when the skier is wearing mittens.

In a different known adjusting mechanism there are provided two toothed rails between which is arranged in position of use a locking member which carries two toothed locators. This locking member is supported swingably against the force of a leaf spring which is arranged thereon in the manner of a clamp. By pulling on the operating shoulder of the locking member, same can be swung upwardly against the force of the leaf spring and thus the teeth can be disengaged. However, it is very difficult to grip the operating shoulder, which makes handling extremely complicated and requires generally a leverlike auxiliary means, with which the locking member can be swung upwardly.

In a further known binding Salomon U.S. Pat. No. 3,785,666, a slide member is provided which is movable transversely to the longitudinal direction of the ski against the force of a spring, which slide member engages one or more teeth approximating square holes in a carriage. The teeth are provided in the direction of movement of the slide member. Therefore, the spring which holds the slide member must be constructed relatively strongly, so that during high stresses, as they are naturally transmitted onto the binding parts during skiing, the teeth are not moved out of the square holes. For this reason the teeth may not be shaped as points in the usual manner but must be substantially straight or only slightly conical. Furthermore, the slide member must be operated by pull, which is not only generally difficult but often impossible due to the strong springs. Therefore, to operate this arrangement, a lever-like part, for example a screwdriver, must be introduced between the open end of the slide member and the base plate secured on the ski, by means of which it is then possible to effect movement of the slide member and thus a release of the locking means. A further disadvantage consists also in the square holes requiring a large space between one another, which permits an adjustment only in very large steps.

SUMMARY OF THE INVENTION

The purpose of the invention is to produce an adjusting mechanism, which can be operated in a simple manner by a light pressure and will eliminate any danger that the high forces can affect the lock in any manner.

This objective is reached by the teeth of the toothed rail and of the toothed locator extending transversely to the direction of movement of the slide member. This projects laterally of the binding and is supported movably against the force of the spring to release the toothed locator from the toothed rail and rests in the other direction on a stop.

The spring, which acts onto the slide member may be constructed relatively weak, because its only task consists in holding the slide member in the position of use. By arranging the teeth transversely to the direction of movement of the slide member, the danger is also overcome that the high stresses occurring during skiing effect in any manner through the teeth a movement of the slide member against the force of the weak spring. This makes it also possible to provide a known small spacing for the teeth, which so far has not been possible in connection with a slide member in order to permit adjustment in very small steps.

BRIEF DESCRIPTION OF THE DRAWING

The subject matter of the invention is illustrated exemplarily in one embodiment in the drawing, in which.

DETAILED DESCRIPTION

Figure 1:
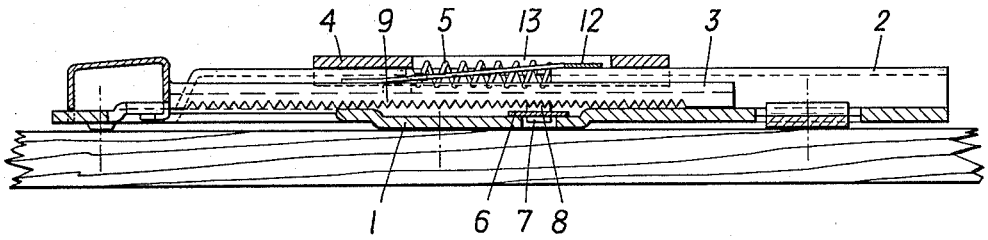
FIG. 1 is a cross-sectional front view of an adjusting mechanism embodying the invention.
Figure 2:
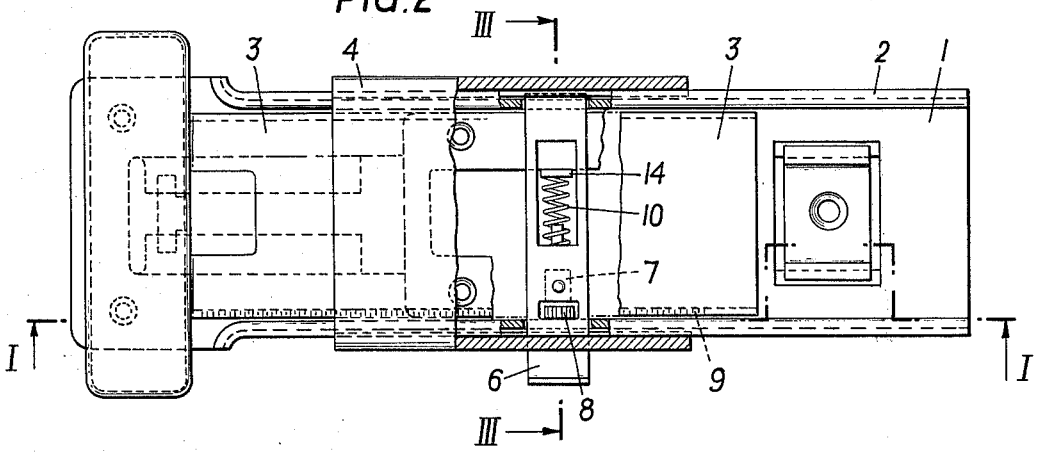
FIG. 2 is a top view of FIG. 1, partially cut.
Figure 3:
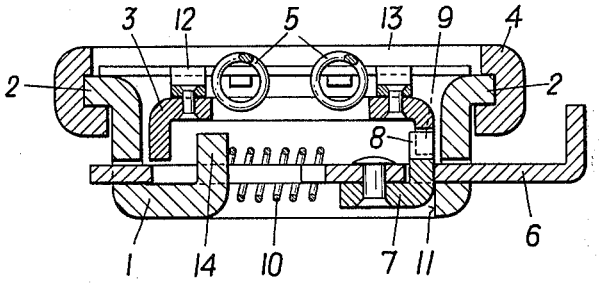
FIG. 3 is a cross-sectional view along the line III—III of FIG. 2.

As illustrated in the drawing, a base plate 1 is provided, which defines a guideway 2 for a carriage which consists of stepping plate 3 and guide plate 4. The base plate 1 is mounted on the ski and one binding part is mounted on the guide plate 4. The guide plate can be moved relative to the stepping plate 3 through a selected zone against the force of the two thrust springs 5. Upon a correct adjustment, the binding part secured on the guide plate 4 is pressed correspondingly against the ski boot by the thrust springs 5. An indicator 12, which extends into a recess 13 of the guide plate 4, indicates the magnitude of the thrust force.

A slide member 6 is supported transversely movably in the base plate. A toothed locator 7 is riveted on this slide member, which toothed locator engages with its teeth 8 the toothed rail 9 provided on the stepping plate 3. This engagement is caused by the spring 10, which is supported at one end on a bent portion 14 of the base plate and at the other end on the toothed locator 7. The toothed locator rests in turn against the stop 11, which is formed by the base plate 1. Thus the slide 6 and through it also the carriage 3, 4 are held in the desired position.

If an adjustment is to be carried out, the slide 6 is moved under a light pressure against the force of the spring 10, namely until the teeth 8 of the toothed locator 7 disengage the toothed rail 9. The carriage 3, 4 or the binding can now be moved into the desired position. After the slide member 6 is released, the teeth 8 of the toothed locator 7 will then engage the toothed rail 9, to hold same against undesired relative displacement. The forces which occur during use cannot be transmitted, as clearly appearing from the construction, through the toothed rail 9 and the toothed locator 7 onto the spring 10. Therefore, it is possible to construct the spring 10 as a relatively weak spring. It must only hold the slide member in the position of use.

Of course, the invention is not limited to the illustrated exemplary embodiments. There are numerous possibilities for modification which all lie within the scope of the invention. For example, it would also be possible to fixedly connect the toothed rail with the base plate and to arrange the slide member with the toothed locator in the carriage. Basically, the arrangement of practically all known bindings available on the market is also possible on adjusting mechanisms according to this invention.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An adjusting mechanism for use with a ski binding, comprising:

base means;

guide means on said base means;

carriage means movably guided on said guide means;

releasable locking means for releasably locking said carriage means to said base means, said releasable locking means including an elongated row of first teeth means on one of said carriage means and said base means extending in a direction parallel to the direction of movement of said carriage means on said guide means and a locking slide member on the other of said carriage means and said base means and having second teeth means thereon engageable with said first teeth means;

resilient means for resiliently urging said second teeth means into engagement and vertical alignment with said first teeth means; and support means for supporting said locking slide member for reciprocal movement in a direction transverse of said direction of movement of said carriage means to effect a movement of said second teeth means into and out of engagement and vertical alignment with said first teeth means, said support means including stop means directly engaging said locking slide member for limiting the movement of said locking slide member under the urging of said resilient means to effect a meshing, vertical alignment with said first and second teeth means while said locking slide member is engaging said stop means.

2. An adjusting mechanism for a ski binding, comprising:

base means;

guide means on said base means;

carriage means movably guided on said guide means, said carriage means comprising first and second relatively movable and parallel plates movable in directions parallel to said guide means, one of said first and second plates having said ski binding mounted thereon and movable therewith;

first resilient means connected to and extending between said first and second plates for resiliently resisting movement of said first and second plates in opposite directions;

releasable locking means for releasably locking said carriage means to said base means, said releasable locking means including an elongated row of first teeth means on one of said first and second plates of said carriage means extending in a direction parallel to the direction of movement of said carriage means on said guide means and a locking slide member on said base means and having second teeth means thereon engageable with said first teeth means;

second resilient means for resiliently urging said second teeth means into engagement with said first teeth means;

support means on said base means for supporting said locking slide member for horizontal reciprocal movement transverse of said direction of movement of said carriage means to effect a movement of said second teeth means into and out of engagement with said first teeth means and including stop means for limiting the movement of said locking slide member under the urging of said second resilient means to effect a meshing, vertical alignment with said first and second teeth means while said locking slide member is engaging said stop means, said support means, said guide means and said carriage means further including means for positively preventing a vertical separation between said first and second teeth means when said first and second teeth means are aligned and meshed with each other.

3. An adjusting mechanism according to claim 2, wherein said locking slide member comprises an elongated slide having a manually engageable portion at one end and a toothed locator secured to said slide and movable therewith; and wherein said second resilient means comprises a spring engaging at one end thereof said toothed locator to urge said toothed locator into engagement with said stop means.

4. An adjusting mechanism for a ski binding, comprising:

base means;

guide means on said base means;

carriage means movably guided on said guide means;

releasable locking means for releasably locking said carriage means to said base means, said releasable locking means including an elongated row of first teeth means on said carriage means extending in a direction parallel to the direction of movement of said carriage means on said guide means and a locking slide member on said base means and having second teeth means thereon engageable with said first teeth means;

resilient means for resiliently urging said second teeth means into engagement with said first teeth means; and support means for supporting said locking slide member on said base means for reciprocal horizontal movement in a direction transverse of said direction of movement of said carriage means to effect a movement of said second teeth means into and out of engagement with said first teeth means, said first and second teeth means being in vertical alignment when in meshing engagement with each other, said support means including stop means for limiting the movement of said locking slide member under the urging of said resilient means to effect a meshing alignment with said first and second teeth means while said locking slide member is engaging said stop means, said support means supporting said locking slide member for horizontal movement toward and away from said stop means against the urging of said resilient means, said support means, said guide means and said carriage means further including means for positively preventing a vertical separation between said first and second teeth means when said first and second teeth means are aligned and meshed with each other.

5. An adjusting mechanism according to claim 4, wherein said locking slide member comprises an elongated slide having a manually engageable portion at one end thereof and a toothed locator secured to said slide and movable therewith; and wherein said resilient means comprises a spring engaging at one end thereof said toothed locator to urge said toothed locator into engagement with said stop means.

* * * * *